US006126525A

United States Patent [19]

Watkin

[11] Patent Number: 6,126,525

[45] Date of Patent: Oct. 3, 2000

[54] OSCILLATING CONTROL CAGE FOR A BLAST WHEEL

[76] Inventor: Robert B. Watkin, RBW Enterprises, Inc., 287 Millard Farmer Industrial Blvd., Newnan, Ga. 30263

[21] Appl. No.: 09/346,759

[22] Filed: Jul. 1, 1999

[51] Int. Cl.[7] ..... B24C 5/06

[52] U.S. Cl. ..... 451/95; 451/75; 451/97; 451/99; 451/100

[58] Field of Search ..... 451/75, 97, 99, 451/95, 100

[56] References Cited

U.S. PATENT DOCUMENTS

| | | | |
|---|---|---|---|
| 4,176,502 | 12/1979 | Leliaert . | |
| 4,291,509 | 9/1981 | Schulte et al. | 451/95 |
| 4,333,278 | 6/1982 | Schulte et al. | 451/97 |
| 4,480,413 | 11/1984 | Schulte et al. . | |
| 5,769,693 | 6/1998 | Wadephul | 451/95 |

*Primary Examiner*—David A. Scherbel
*Assistant Examiner*—Shantese McDonald
*Attorney, Agent, or Firm*—Piper Marbury Rudnick & Wolfe

[57] ABSTRACT

A blast surface treating machine utilizes a control cage featuring an inlet and an outlet that is positioned with its outlet within the central space of the machine blast wheel. A hopper supplies particulate material to the control cage inlet. A rotating screw conveyor transports the particulate material through the control cage. The screw conveyor also forces the particulate material out of the control cage outlet where it is picked up by the rotating blast wheel. The control cage is oscillated about the axis of the blast wheel to provide a widened blast pattern upon the surface being treated. The blast wheel, blast wheel housing, control cage and screw conveyor are constructed of manganese or hardened steel to provide the an anti-shattering construction in the event that a bolt or other foreign object falls into the hopper.

20 Claims, 8 Drawing Sheets

OSCILLATING CONTROL CAGE FOR A BLAST WHEEL

BACKGROUND OF THE INVENTION

1. Field of Invention

The invention relates generally to blast surface treating machines whereby particulate material is thrown with centrifugal force from a rotating blast wheel onto a surface so that paint, dirt, burrs and the like are removed and, more particularly, to a blast surface treating machine wherein the particulate material is fed to the rotating blast wheel through an oscillating control cage via a screw conveyor and that features an anti-shattering construction.

2. Description of Prior Art

Blast surface treating machines of the type indicated generally at 20 in FIG. 1 are well known in the art. Such machines feature a hopper 22 within which a supply of particulate material 24 is maintained. The particulate material may be steel shot, sand, gravel or the like. A blast wheel 26 featuring throwing blades 28 is mounted to the hub of a motor 32 and rotates at a high velocity about an axis 33. The hopper communicates with the center of the blast wheel via feed spout 34 so that the particulate material is supplied to the center of the rotating blast wheel. As a result, the particulate material is propelled by centrifugal force through a passage defined by guard housing 36 towards a surface 42 such as steel or concrete from which paint, dirt or burrs are to be removed. After rebounding off of the surface, the particulate material, along with the debris removed from the surface, travels through the rebound chute 44 to the hopper. A fan (not shown) may be used to create an airflow through the rebound chute towards the hopper. The debris is removed from the hopper via a dust collection arrangement 46.

The details of a typical prior art blast surface treating machine are illustrated in FIGS. 2 and 3. Such machines are available from The Wheelabrator Corporation of La Grange, Ga. As described above, the machine features a blast wheel 50 equipped with throwing blades 52. The blast wheel is mounted to a hub 54 which is connected to a shaft 56 by bushing 58. The shaft is rotated by a motor such as the one indicated at 32 in FIG. 1.

A control cage 62 is positioned within the cylindrical space defined by the inner edges of the blades of the blast wheel. As shown in FIG. 4, the control cage is cylindrical and features an opening 64 as well a serrated edge 66. The control cage is secured to adapter plate 68 which is secured to guard housing 72. Guard housing 72 is secured to base plate 74 which has an opening 76. More specifically, the control cage is secured to the adapter plate via clamp 82 and bolt 84 so that the orientation of opening 64 may be adjusted. The control cage remains fixed as the blast wheel rotates.

An impeller 86 is also secured to shaft 56 via bolt 90 and is sized to rotate freely within the control cage. As a result, the impeller rotates along with the blast wheel. As shown in FIG. 5, the impeller is also cylindrical and features multiple openings 92. A feed spout 94 supplies particulate material to the impeller from a hopper such as the one indicated at 22 in FIG. 1. As the impeller spins, the particulate material is forced through the control cage opening 64 and onto the blast wheel blades 52. As a result, the particulate material is propelled by centrifugal force towards a surface through opening 76. The particulate material leaves the blasting wheel at an angle of approximately 180° from the control cage opening 64.

While blast surface treating machines of the type described above perform admirably, they suffer from disadvantages. The width of the path treated as the machine is moved along a surface, called the blast pattern or "hot spot", is limited by the size of the control cage opening and the position of the machine relative to the surface. A larger control cage opening produces a wider blast pattern. If the opening is too large, however, the machine will bog down and the velocity of the particulate material will decrease. This will adversely impact the treating ability of the machine. A larger distance between the machine and the surface will also produce a wider blast pattern. If the distance is too great, however, the particulate material will lose velocity before it impacts the surface so that treating is adversely impacted. Furthermore, spacing the machine a great distance from the surface requires a more cumbersome guard housing and makes recovery of the particulate material difficult. The size of the control cage opening and the distance of the machine from the surface being treated therefore must be limited. As a result of these limitations, the blast pattern width of prior art blast surface treating machines is typically approximately six inches. A wider blast pattern would allow a surface to be treated with a fewer number of machine passes. In addition, a wider blast pattern would provide more uniform treating of a surface in that there would be less overlapping treated portions of the surface.

The impeller, control cage and blast wheel of prior art blast machines are typically constructed of cast metallic material. As a result, the components are very brittle. Objects such as screws, bolts or the like may accidently fall into the hopper of a blast surface treating machine. Such an object would travel to the impeller and be forced out of the control cage opening. As a result, the object could be wedged or pinched between the rotating impeller and the fixed control cage opening. When this occurs with prior art machines, the impeller, due to its brittleness, shatters and the resulting debris is passed out onto the blast wheel blades. As a result, the blast wheel blades may also shatter.

Accordingly, it is an object of the present invention to provide a blast surface treating machine that provides a wider blast pattern.

It is another object of the present invention to provide a blast surface treating machine that features an anti-shattering construction.

SUMMARY OF THE INVENTION

The present invention is directed to a blast machine for treating a surface with particulate material. The machine features a blast wheel including a central space and a motor for rotating the blast wheel about its axis. A control cage having an inlet and an outlet is positioned so that its outlet is located within the central space of the blast wheel. A screw conveyor is positioned within the control cage and is rotated by a chain drive and a second motor. A hopper supplies particulate material to the inlet of the control cage. The screw conveyor transports the particulate material through the control cage and out of its outlet. This particulate material is received by the throwing blades of the rotating blast wheel and is propelled against the surface. A gravity feed and impeller arrangement of the type illustrated in FIGS. 2 and 3 may be substituted for the screw conveyor.

A mechanism for oscillating the control cage about the axis of the blast wheel includes an oscillating plate attached to the control cage. The oscillating plate includes a tab. A pneumatic cylinder features a first end connected to the tab of the oscillating plate and a second end fixed to the main frame of the machine. A pair of limit switches that communicate with solenoid valves and an air source are mounted on the pneumatic cylinder so that it cyclically extends and retracts. As a result, the plate, and therefore the control cage, oscillate. This results in the production of a wider blast pattern upon the surface. Alternatively, the control cage may be oscillated by a rotating linkage arm arrangement that is powered by a chain connected to a sprocket mounted upon the screw conveyor shaft.

The blast wheel housing and blast wheel are preferably constructed of manganese steel to provide the machine with an anti-shattering construction in the event that a bolt or other foreign object is deposited in the hopper. The screw conveyor and the control cage may also be constructed of hardened steel.

The following detailed description of embodiments of the invention, taken in conjunction with the appended claims and accompanying drawings, provide a more complete understanding of the nature and scope of the invention.

DESCRIPTION OF THE PREFERRED EMBODIMENT

Figure 6:
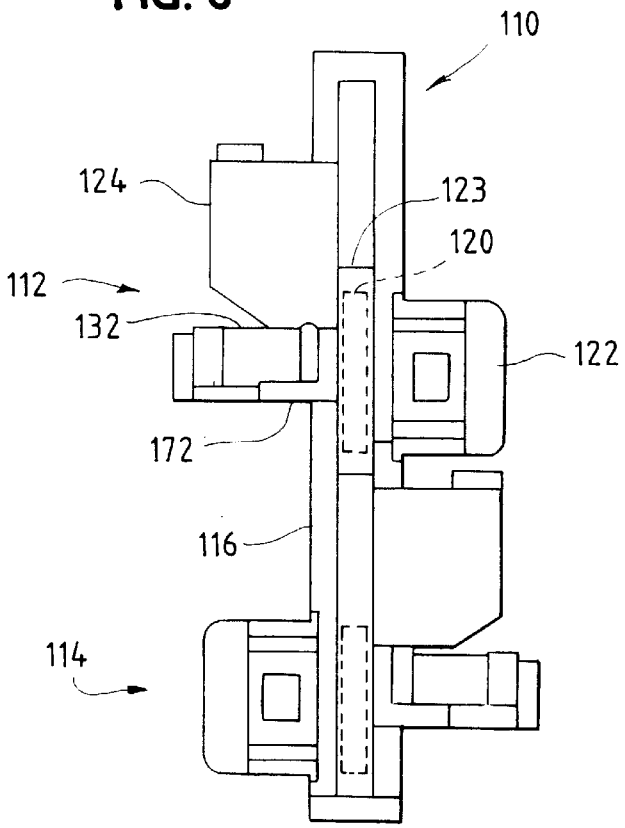
FIG. 6 is a side elevation view of a blast surface treating machine constructed in accordance with the present invention.

A blast surface treating machine constructed in accordance with the present invention is indicated in general at 110 in FIG. 6. The machine is particularly suited for treating generally vertical surfaces. Examples of such surfaces include, but are not limited to, ship hulls and tank walls. As is known in the art, the machine is suspended by a cable arrangement from vertically above the surface. As a result, the machine may travel in both a vertical and horizontal direction along the surface.

The machine 110 actually features two blast surface treating machines or mechanisms in a stacked configuration. The upper blast mechanism 112 is essentially a mirror image of the lower blast mechanism 114. The machine 110 features a main frame 116 that supports the blast wheels, and their housings, for both the upper and lower blast mechanisms. The main frame also serves as the main support structure by which the machine may be suspended. To eliminate redundancy, only the components of the upper blast mechanism will be discussed in detail.

Figure 1:
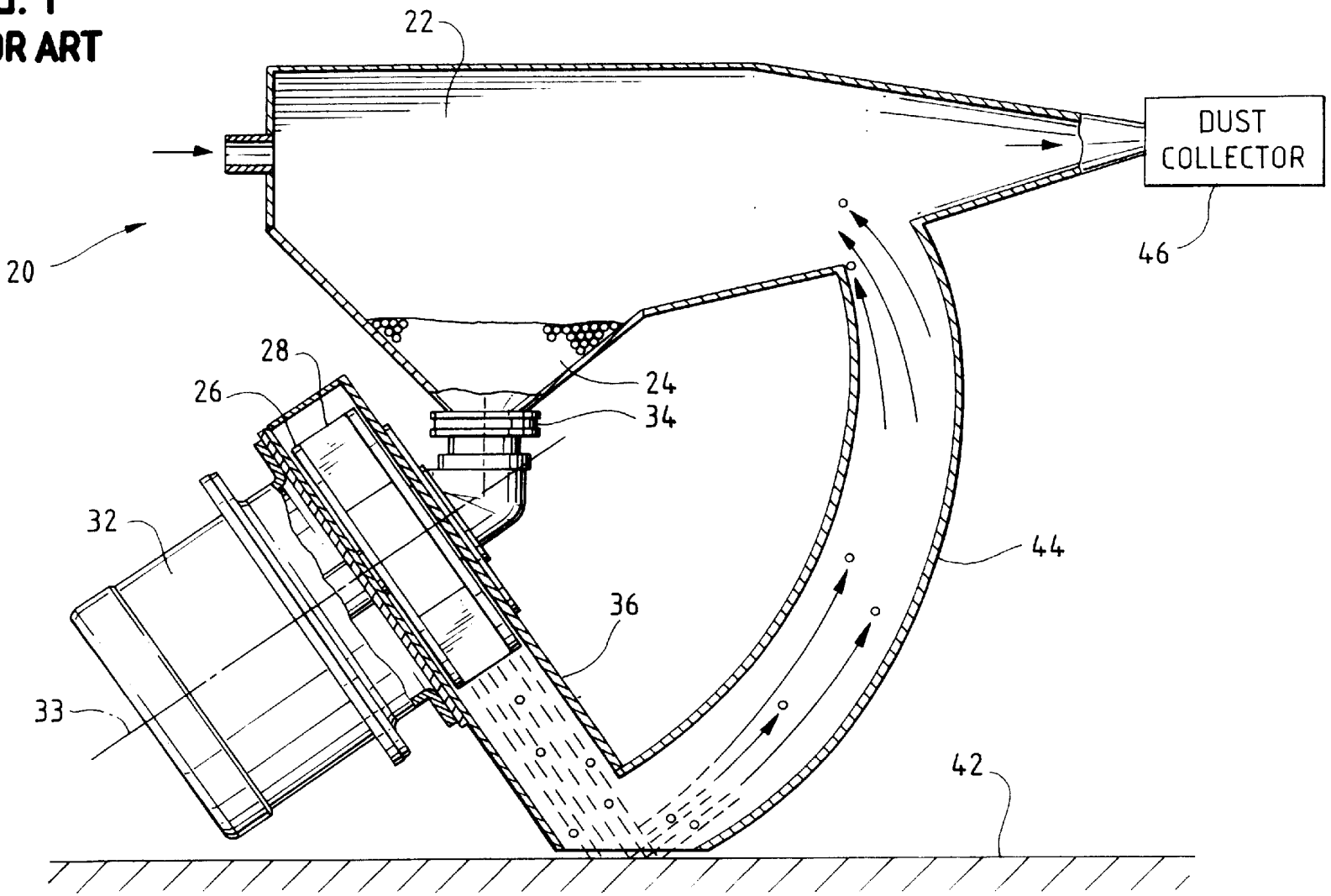
FIG. 1 PRIOR ART
FIG. 1 is a partially broken-away side elevation view of a prior art blast surface treating machine.
Figure 2:
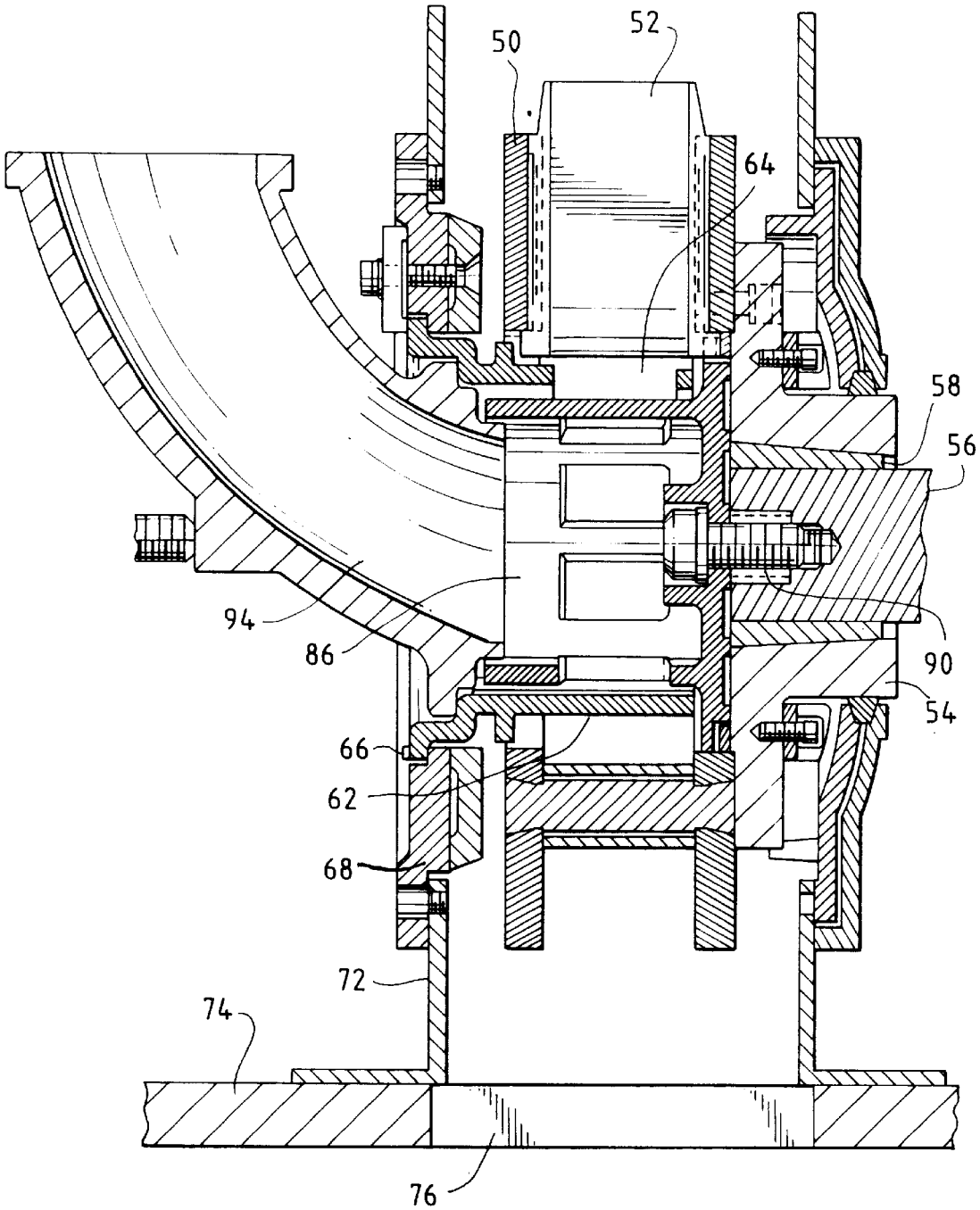
FIG. 2 PRIOR ART
FIG. 2 is a sectional side elevation view of the blast wheel and related components of a prior art blast surface treating machine.
Figure 3:
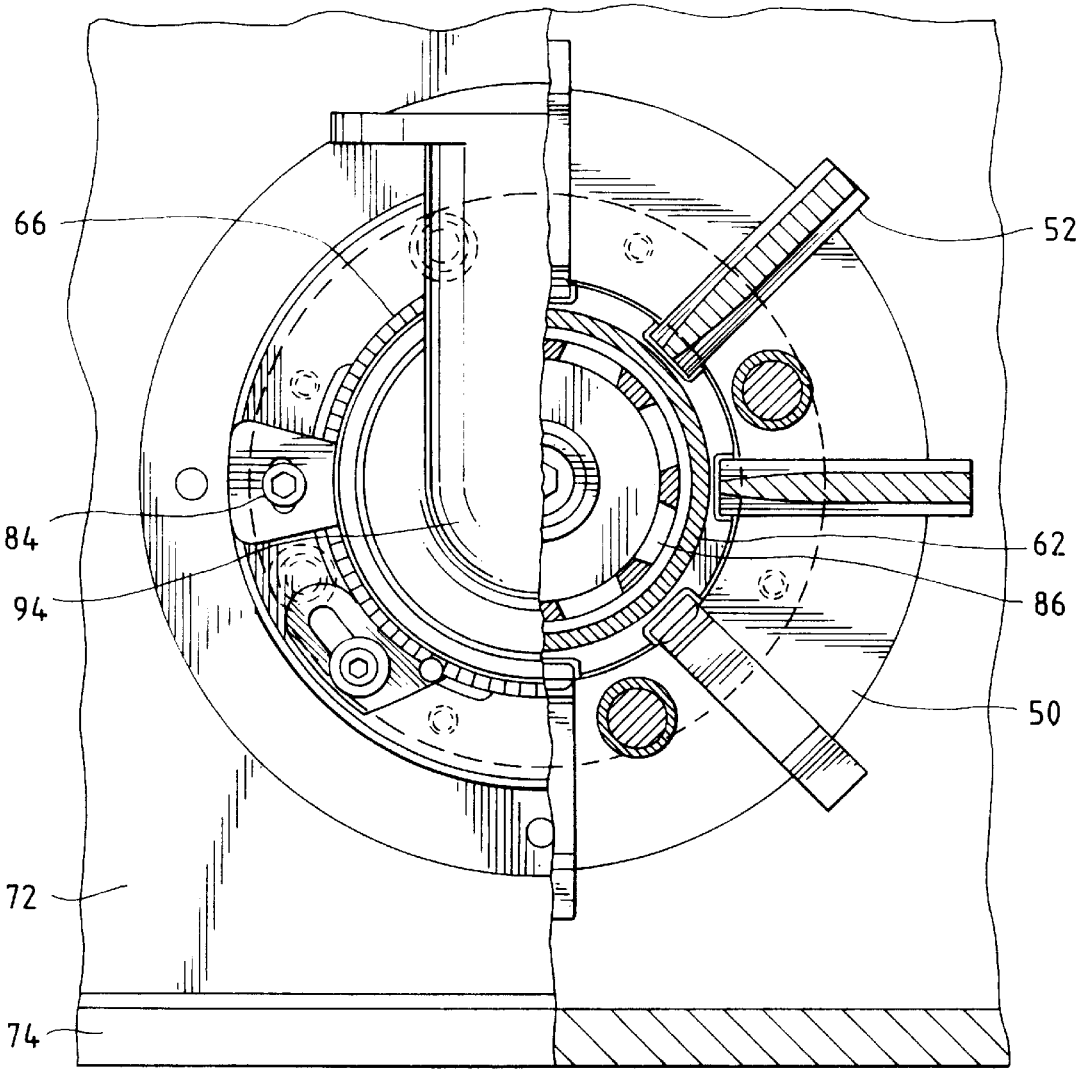
FIG. 3 PRIOR ART
FIG. 3 is a partially broken-away end elevation view of the blast wheel and related components of FIG. 2.
Figure 4:
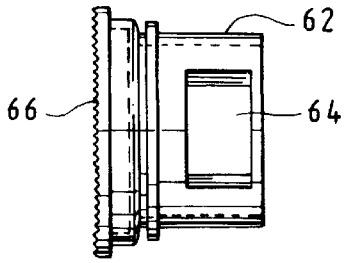
FIG. 4 PRIOR ART
FIG. 4 is an enlarged top plan view of the control cage of FIGS. 2 and 3.
Figure 5:
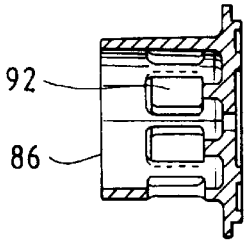
FIG. 5 PRIOR ART
FIG. 5 is an enlarged side elevation view of the impeller of FIGS. 2 and 3.

The upper blast wheel, indicated in phantom at 120, which is similar in structure to the blast wheel of FIGS. 1–3, is rotated by a blast wheel motor 122 and is positioned within blast wheel housing 123. The blast wheel motor may be powered by electricity and is sized to suit the particular application. The blast wheel motor could be powered by a variety of alternative substances, including, but not limited to, gasoline or pressurized air. A motor of approximately thirty horsepower, for example, is suitable for performing a variety of treating operations on steel or concrete surfaces. The blast wheel is also sized depending upon the application. As an example only, a blast wheel of approximately sixteen inches in diameter is suitable for performing treating operations on steel or concrete surfaces.

A hopper 124 supplies particulate material, such as sand, steel shot or the like, to the blast wheel so that the particulate material may be propelled against a surface in the manner shown in FIG. 1. As will be discussed in greater detail, a second motor 132 powers the mechanism for delivering the particulate material to the rotating blast wheel. The motor may optionally be operable at various speeds to provide a variable speed drive. A gravity feed and impeller arrangement of the type illustrated in FIGS. 2 and 3 may be substituted for the motor 132 and the delivery mechanism. A variety of methods known in the art, such as tubing or duct work and a fan, may be used to recirculate the particulate material and debris back to the hopper. As is known in the art, the hopper may feature a separator system or a dust collection arrangement for separating the particulate material from the debris.

Figure 7:
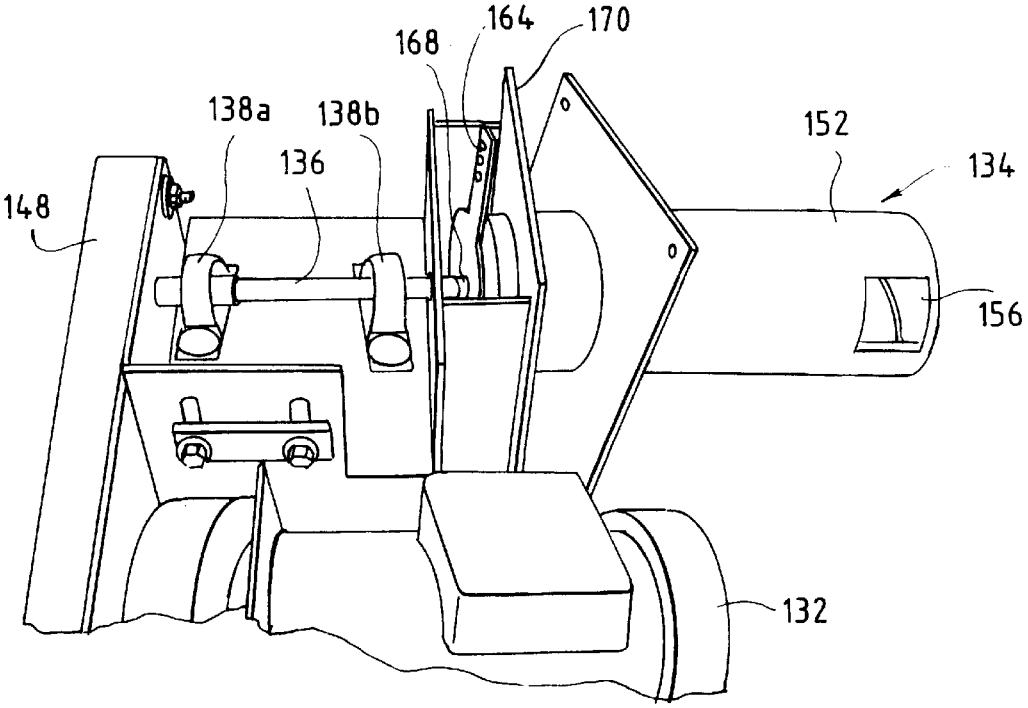
FIG. 7 is a side and top perspective view of the screw conveyor and control cage assembly of the blast surface treating machine of FIG. 6.
Figure 8:
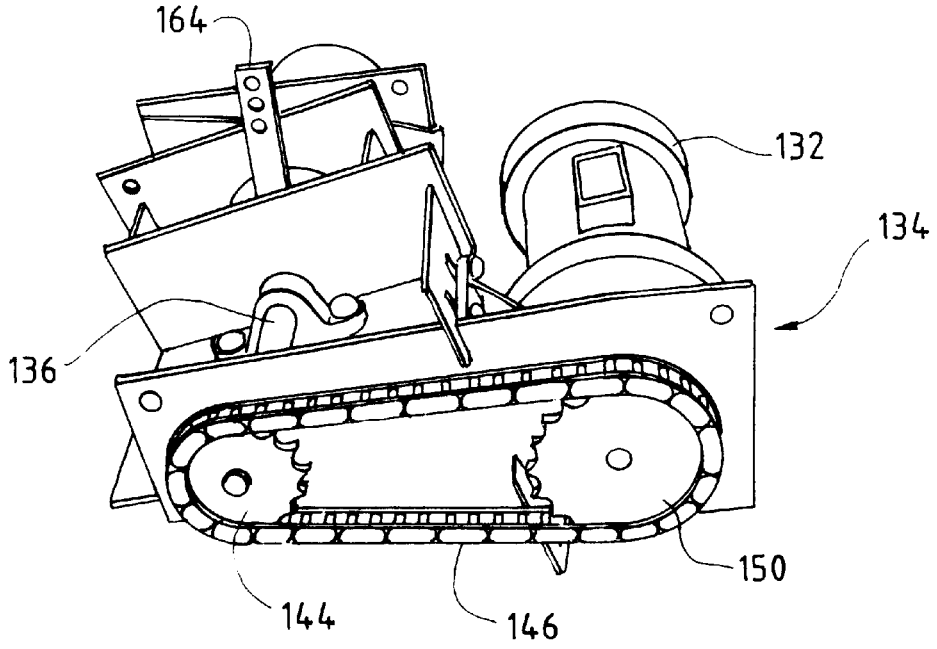
FIG. 8 is an end and top perspective view of the screw conveyor and control cage assembly of FIG. 7.
Figure 9:
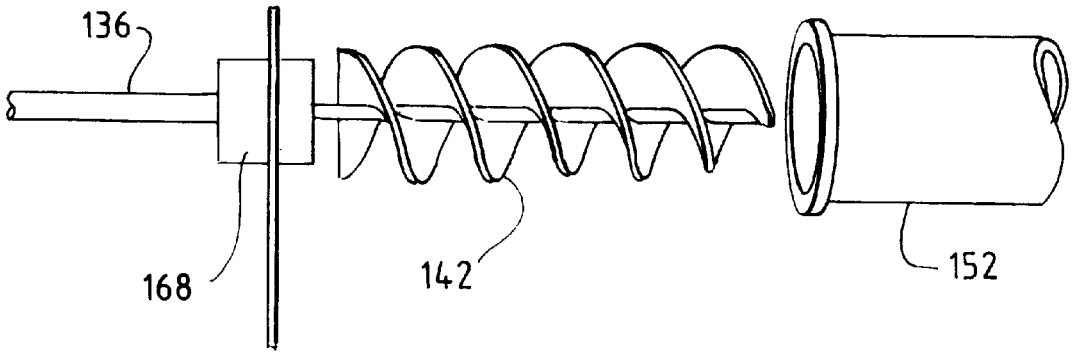
FIG. 9 is a side elevation view of the screw conveyor of FIG. 7.

As shown in FIGS. 7 and 8, motor 132 is part of the screw conveyor and control cage assembly, indicated in general at 134. A screw conveyor shaft 136 is secured in position by bearings 138*a* and 138*b* so that it may rotate. As illustrated in FIG. 9, the distal end of the shaft is connected to a screw conveyor 142. The opposite end of the shaft features sprocket 144. Sprocket 144 is joined by a drive chain 146 to a sprocket 150 which is mounted to the shaft of motor 132. As a result, actuation of the motor causes the screw conveyor to rotate. A chain guard 148 is positioned so as to surround the chain and the sprockets.

Figure 11:
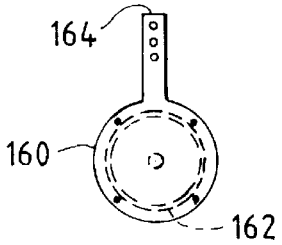
FIG. 11 is an end elevation view of the oscillating arm plate and control cage of FIG. 7.
Figure 10:
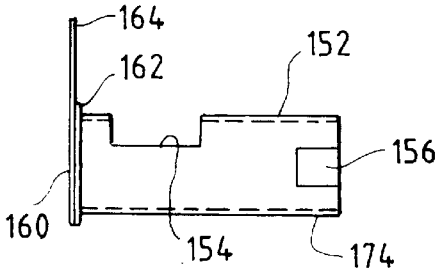
FIG. 10 is a side elevation view of the oscillating arm plate and control cage of FIG. 7.
Figure 13:
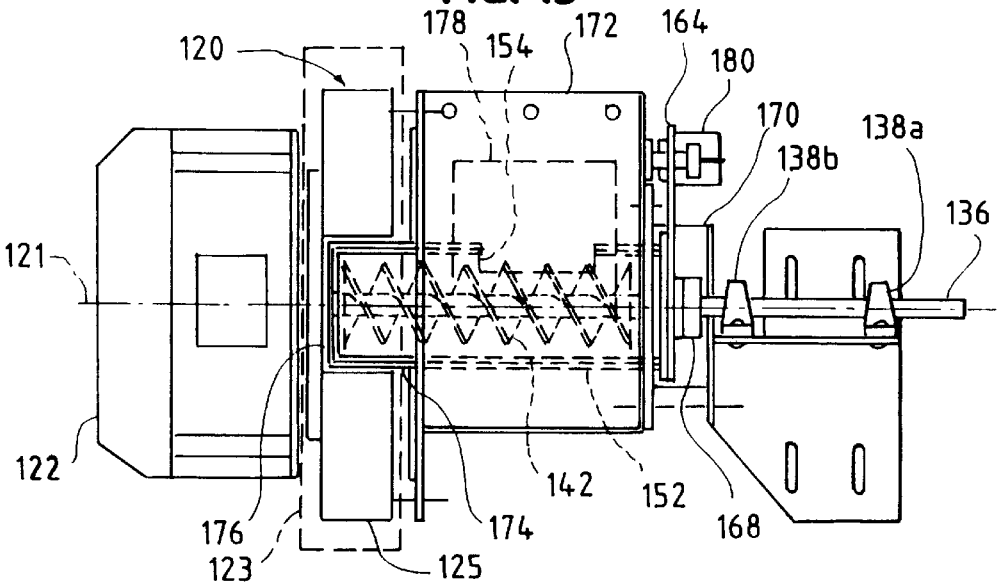
FIG. 13 is a side elevation view, taken from opposite the side shown in FIG. 6, of the screw conveyor and control cage assembly of FIGS. 7 and 8 as mounted upon the blast machine of FIG. 6 with the motor and associated drive chain and sprockets omitted.

As illustrated in FIGS. 7 and 9, a control cage 152, preferably constructed as a mild steel tube, is placed over the screw conveyor 142 in a sleeve-like fashion. The control cage is sized to allow the screw conveyor to rotate freely therein. As shown in FIG. 10, the control cage features particulate material inlet 154 and outlet 156. An oscillating plate 160 is secured to the rim 162 of the control cage via welding, bolts or other attachment means. The oscillating plate features a tab 164, best shown in FIG. 11. The oscillating plate 160 is positioned upon the screw conveyor shaft 136 via flange bearings 168. As such, the oscillating plate and control cage may rotate about the screw conveyor shaft. As shown in FIGS. 7 and 13, the oscillating plate and flange bearings 168 are positioned within enclosure 170. The enclosure features an opening sized to accommodate the control cage. The control cage is supported in the enclosure opening by a ring seal.

As illustrated in FIG. 13, the screw conveyor and control cage assembly are mounted so that the control cage inlet 154 is positioned facing upwards within a box 172 that receives particulate material from the hopper 124 (FIG. 6). The box may feature an opening 178 so clogs of particulate material surrounding inlet 154 may be cleared. The distal end 174 of the control cage extends out of the box 172 and into the central cylindrical space 176 at the hub of the blast wheel, indicated generally at 120. As a result, when screw conveyor 142 is rotating, particulate material is received through control cage inlet 154, moved through the control cage 152 and forced out of the control cage outlet 156 (illustrated in FIGS. 7 and 10). This particulate material is intercepted by the throwing blades 125 of the blast wheel 120, which is rapidly rotating about its axis 121, and propelled towards a surface.

It should be noted that a gravity feed and impeller arrangement, of the type illustrated in and discussed with regard to FIGS. 2 and 3, may be substituted for the screw conveyor as a means for transferring the particulate material from the control cage inlet, through the control cage and out of the control cage outlet.

Figure 14:
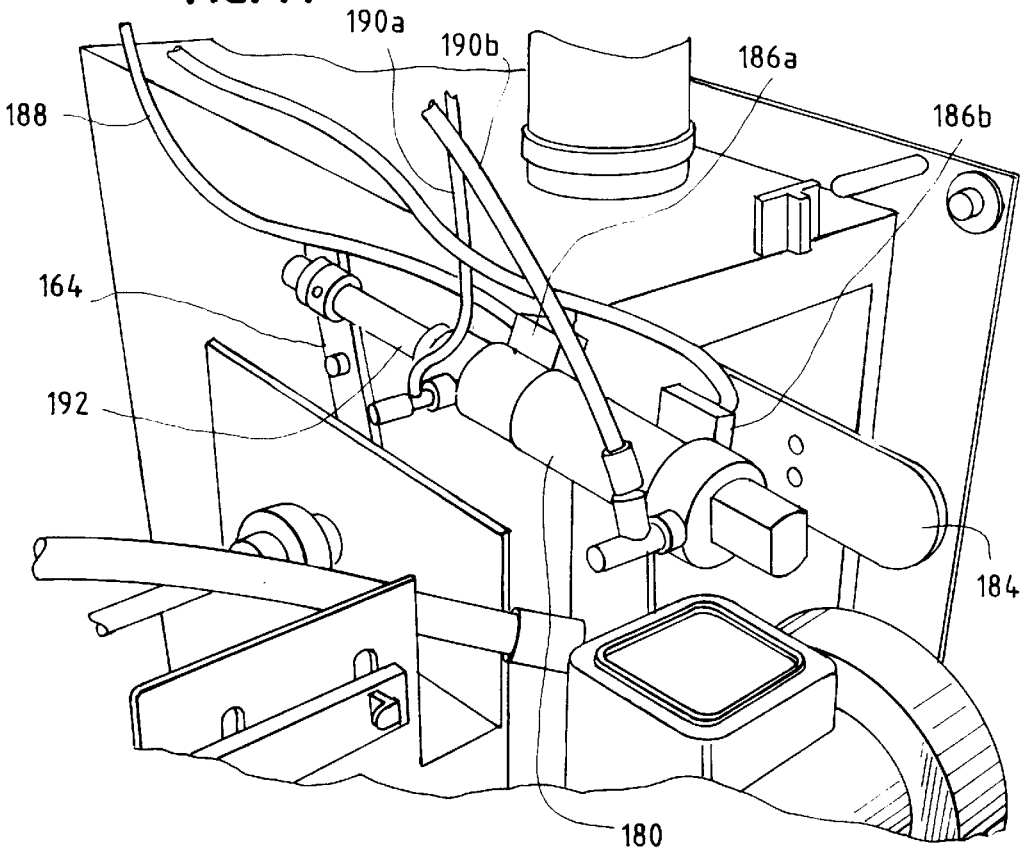
FIG. 14 is an enlarged perspective view of the pneumatic cylinder of FIGS. 12 and 13.

A pneumatic cylinder 180 features one end attached to the tab 164 of oscillating plate 160. As shown in FIG. 14 the opposite end of the pneumatic cylinder is attached to a bracket 184 that is attached to the main frame 116 (FIG. 6) of the machine. A pair of limit switches 186*a* and 186*b* are positioned on opposite ends of the pneumatic cylinder and are in communication with a control box (not shown) via wires 188. A source of compressed air (not shown) communicates with the pneumatic cylinder via hoses 190*a* and 190*b* as dictated by solenoid valves in the control box. In operation, one of the air hoses, for example, 190*a*, is pressurized so that the pneumatic cylinder retracts. As a result, switch 186*b* is tripped. Switch 186*b* sends a signal to the control box so that the solenoid valves reverse the air supply and hose 190*b* is pressurized. This causes the pneumatic ad cylinder to extend. As a result, switch 186*a* is tripped and the cycle is repeated. Suitable limit switches and valve components for use with the pneumatic cylinder are well known in the art.

The articulation of the pneumatic cylinder causes the tab 164, and thus the oscillating plate 160, to oscillate. As a result, the control cage 152 oscillates. The angle through which the control cage oscillates may be adjusted via pneumatic cylinder linkage 192. As the control cage oscillates, the particulate material outlet 156 (FIGS. 7 and 10) also oscillates so that the particulate material is delivered to the blast wheel through an arc. As stated previously, the blast pattern or "hot spot" is produced at an angle approximately 180° from the control cage outlet. As a result, a wider blast pattern is produced by the oscillating control cage outlet. For example, oscillating the control cage through a roughly 40° arc results in a blast pattern that is thirty inches wide. This is a significant increase over the six inch width typically produced by prior art blast surface treating machines with stationary control cages. A blast surface treating machine constructed in accordance with the present invention may thus treat a surface with a fewer number of passes. In addition, the surface treating is more uniform as there are fewer overlapping areas, that is, areas that are exposed to blast treating twice during successive passes of the machine. The upper and lower blast mechanisms 112 and 114 may optionally be mounted at an angle to one another to provide a still wider blast pattern for a machine pass.

The control cage inlet 154 (FIGS. 10 and 13) also oscillates when the pneumatic cylinder is activated. This improves the delivery of the particulate material to the screw conveyor by reducing the formation of clumps.

Figure 12:
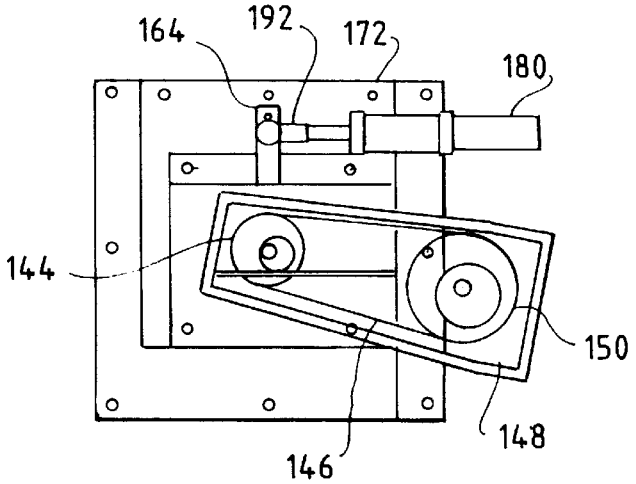
FIG. 12 is an end elevation view of the screw conveyor and control cage assembly of FIGS. 7 and 8 as mounted upon the blast machine of FIG. 6.
Figure 15:
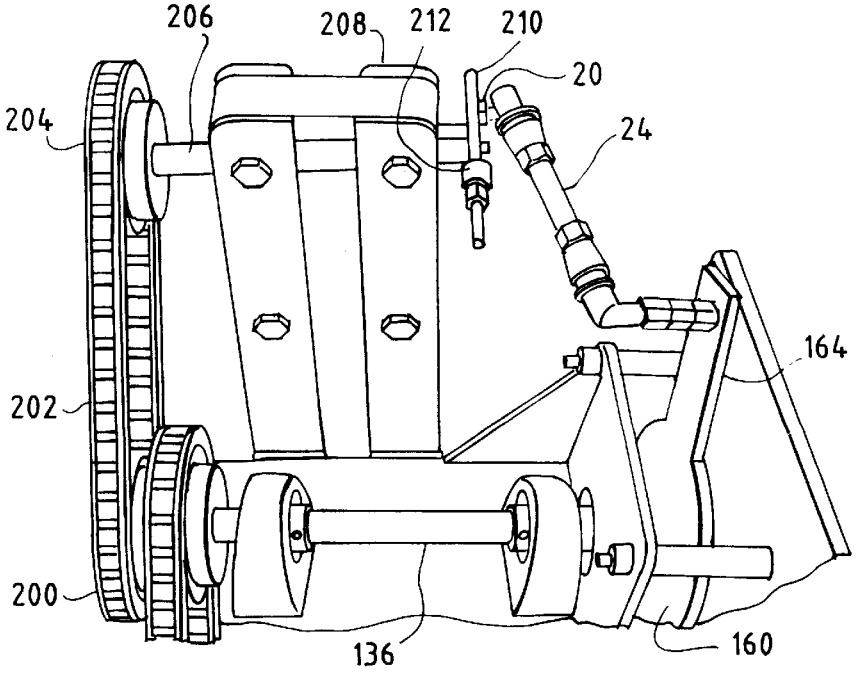
FIG. 15 is a side and top perspective view of the control cage oscillating mechanism of an alternative embodiment of the present invention.

FIG. 15 shows a mechanical oscillating arrangement that may be substituted for the pneumatic cylinder 180 of FIGS. 12–14. A power takeoff from the screw conveyor includes a second sprocket 200 attached to the screw conveyor shaft 136 so that a second drive chain 202 drives a sprocket 204 and shaft 206 supported by a bracket and bearing 208. A reciprocating linkage includes a rotating arm 210 secured to the end of the shaft 206 by a clamp 212. One end of a linkage arm 214 is connected to the distal end of the rotating arm in a pivoting fashion. The opposite end of the linkage arm is pivotally connected to the tab 164 of the oscillating plate 160 by bolt 216. As a result, when the motor 132 (FIGS. 6–8) is activated, drive chain 202 rotates shaft 206 so that the rotating arm 210 spins. This causes the end of the linkage arm 214 connected to the rotating arm to travel in a circle so that its opposite end moves tab 164, and thus oscillating plate 160 and control cage 152, in an oscillating fashion. The length of the linkage arm 214 may be adjusted to control the degree of oscillation. It should be noted that above details of the power takeoff and reciprocating linkage are presented as examples only and that their configuration may vary.

As stated previously, a bolt or similar foreign item may fall into the hopper of a blast surface treating machine. By replacing the impeller of typical blast machines with a screw conveyor, the machine described above minimizes the danger and damage from such an occurrence. More specifically, the foreign item cannot be pinched or wedged between the control cage outlet and an impeller. In addition, the blades of the blast wheel 120 (FIG. 13) are preferably constructed of mild steel and manganese with a hard facing while the blast wheel housing preferably features an all manganese steel construction. The control cage and screw conveyor may also be hardened. This provides the machine with an "anti-shattering" construction. That is, a foreign object such as a bolt will not cause the blast wheel, blast wheel housing, screw conveyor or control cage to shatter. This is in contrast to the brittle cast blast wheels and housings of prior art blast surface treating machines.

Figure 16:
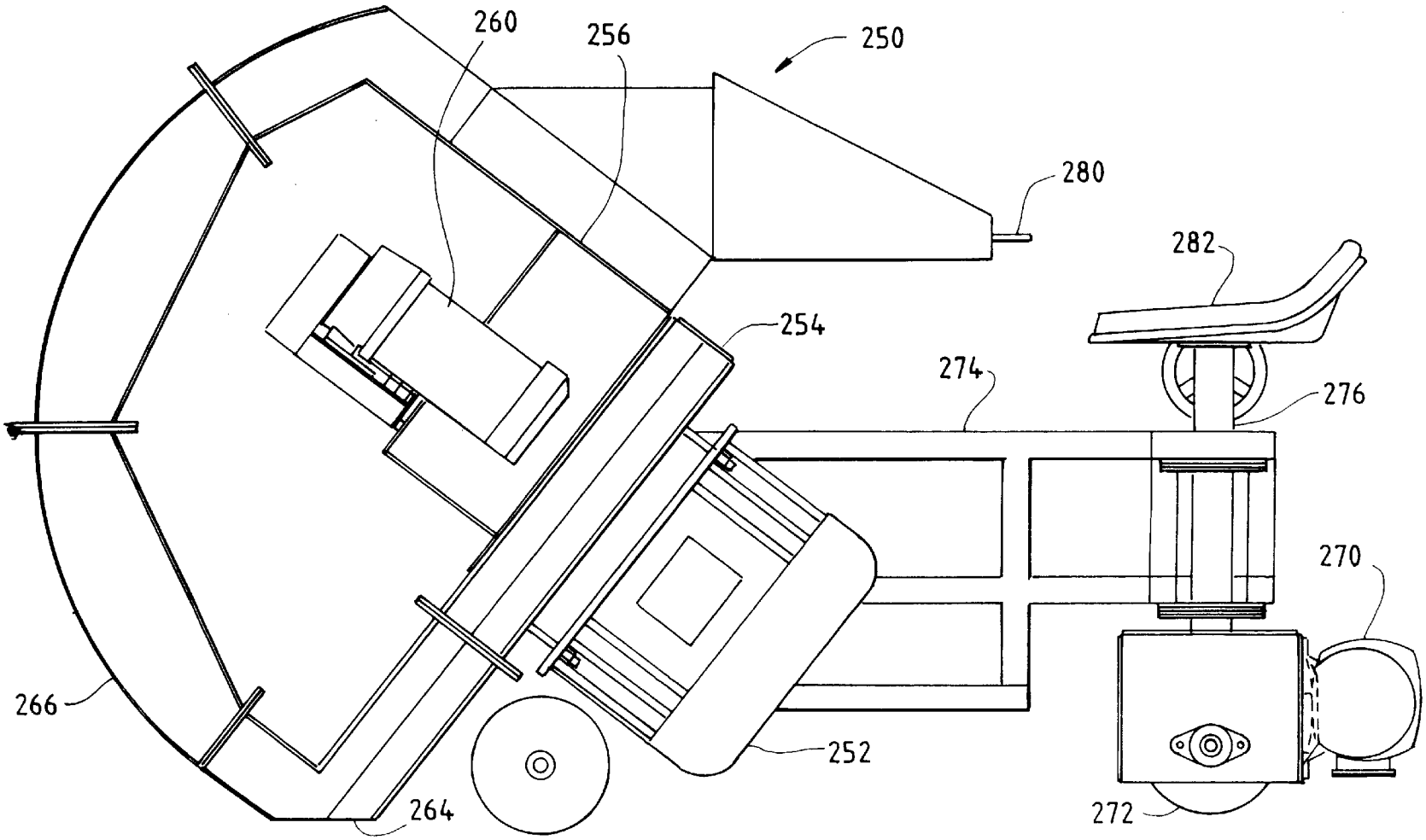
FIG. 16 is a side elevation view of a riding blast surface treating machine constructed in accordance with the present invention.

A riding blast surface treating machine, such as the one indicated generally at 250 in FIG. 16, may also be constructed in accordance with the present invention. Such a machine finds use, for example, in treating floors and roofs. Similar to the blast machine of FIG. 6, the riding blast machine features a motor 252 that powers a blast wheel positioned in housing 254. A hopper 256 provides a supply of particulate material that is fed to the blast wheel with a screw conveyor and control cage assembly such as the one illustrated in FIG. 7 at 134. The screw conveyor is powered by a second motor 260 and the control cage is oscillated using either the pneumatic cylinder of FIGS. 12–14 or the mechanical arrangement of FIG. 15. Particulate material is propelled through the housing 254 onto a surface through opening 264. The particulate material is recirculated back to the hopper, along with the debris removed from the surface, via rebound chute 266.

The riding machine is powered by a motor 270 that drives rear wheels 272. The rear wheels and motor are pivotally mounted to the machine main frame 274 by post 276. An operator grips handle 280 and sits on seat 282, the latter of which is attached to the top of post 276. The operator turns the machine by twisting his or her hips so that the rear wheels 272 turn. The machine may be disassembled so that it may fit through port holes and the like.

While the preferred embodiments of the invention have been shown and described, it will be apparent to those skilled in the art that changes and modifications may be made therein without departing from the spirit of the invention, the scope of which is defined by the appended claims.

What is claimed is:

1. A blast machine for treating a surface with particulate material comprising:

a) a blast wheel including an axis, a plurality of throwing blades and a central space;

b) a motor for rotating the blast wheel about its axis;

c) a control cage having an inlet and an outlet, said control cage positioned so that its outlet is located within the central space of the blast wheel;

d) a screw conveyor disposed within said control cage;

e) means for supplying particulate material to the inlet of the control cage;

f) means for rotating the screw conveyor so that particulate material is transferred from the inlet, through the control cage and out said outlet; and g) a mechanism for oscillating the control cage about the axis of the blast wheel thereby to produce a widened blast pattern as the particulate material is received from said outlet and propelled by said throwing blades onto the surface to be treated.

2. The blast machine of claim 1 further comprising a main frame supporting said blast wheel and wherein the mechanism for oscillating the control cage includes:

a) a pneumatic cylinder featuring a first end connected to the control cage and a second end connected to said main frame; and b) means for actuating said pneumatic cylinder to cyclically extend and retract so that said control cage is oscillated about the axis of the blast wheel.

3. The blast machine of claim 2 wherein the means for actuating said pneumatic cylinder includes limit switches activated by said pneumatic cylinder at its extended and retracted extremes to reverse the direction of movement of said pneumatic cylinder.

4. The blast machine of claim 1 wherein the screw conveyor is attached to a screw conveyor shaft and said control cage is mounted to the screw conveyor shaft by flange bearings.

5. The blast machine of claim 1 wherein the mechanism for oscillating the control cage includes a power takeoff from the screw conveyor which drives a reciprocating linkage attached to the control cage.

6. The blast machine of claim 1 wherein the means for supplying particulate material to the inlet of the control cage includes a hopper.

7. The blast machine of claim 1 further comprising a blast wheel housing constructed of manganese steel and wherein said blast wheel is constructed of manganese steel.

8. The blast machine of claim 7 wherein said screw conveyor and said control cage are constructed of hardened steel.

9. The blast machine of claim 1 wherein said screw conveyor is attached to a screw conveyor shaft and said means for rotating said screw conveyor includes:

a) a sprocket mounted to the screw conveyor shaft;

b) a motor including a sprocket that rotates when the motor is activated; and c) a drive chain extending between the motor sprocket and the sprocket mounted upon the screw conveyor shaft.

10. The blast machine of claim 9 wherein said motor is a variable speed motor.

11. A blast machine for treating a surface with particulate material comprising:

a) a blast wheel having an axis, a plurality of throwing blades and a central space;

b) means for rotating said blast wheel about its axis;

c) a control cage having an inlet and an outlet, said control cage positioned so that its outlet is in communication with the central space of the blast wheel;

d) means for supplying particulate material to the inlet of the control cage;

e) means for transferring the particulate material from the inlet, through the control cage and out of the outlet; and f) means for oscillating the control cage about the axis of the blast wheel thereby to produce a widened blast pattern as the particulate material is received from the outlet and propelled by the throwing blades onto the surface to be treated.

12. The blast machine of claim 11 further comprising a main frame supporting said blast wheel and wherein the means for oscillating the control cage includes:

a) a pneumatic cylinder featuring a first end connected to the control cage and a second end connected to said main frame; and b) means for actuating said pneumatic cylinder to cyclically extend and retract so that said control cage is oscillated about the axis of the blast wheel.

13. The blast machine of claim 12 wherein the means for actuating said pneumatic cylinder includes limit switches activated by said pneumatic cylinder at its extended and retracted extremes to reverse the direction of movement of said pneumatic cylinder.

14. The blast machine of claim 11 wherein the means for transferring the particulate material through the control cage in includes:

a) a screw conveyor positioned within the control cage and attached to a screw conveyor shaft;

b) a sprocket mounted to the screw conveyor shaft;

c) a motor including a sprocket that rotates when the motor is activated; and d) a drive chain extending between the motor sprocket and the sprocket mounted upon the screw conveyor shaft so that said screw conveyor rotates when said motor is activated.

15. The blast machine of claim 14 wherein the means for oscillating the control cage includes a power takeoff from the screw conveyor which drives a reciprocating linkage attached to the control cage.

16. The blast machine of claim 14 wherein the screw conveyor is attached to a screw conveyor shaft and said control cage is mounted to the screw conveyor shaft by flange bearings.

17. The blast machine of claim 11 further comprising a blast wheel housing made of manganese steel and wherein said blast wheel is made of manganese steel.

18. The blast machine of claim 17 wherein said screw conveyor and said control cage are constructed of hardened steel.

19. The blast machine of claim 11 wherein said means for transferring the particulate material from the inlet, through the control cage and out of the outlet includes a gravity feed in communication with the control cage inlet and an impeller rotationally positioned within the control cage.

20. A method for blast treating a surface with particulate material comprising the steps of:

a) providing a blast wheel with an axis and a central space within which a control cage with an outlet is disposed;

b) supplying the control cage with particulate material;

c) transferring the particulate material through the control cage;

d) forcing the particulate material out of the control cage through the control cage outlet;

e) oscillating the control cage about the axis of the blast wheel; and f) rotating a blast wheel so that the particulate material is propelled towards the surface with a widened blast pattern due to the oscillation of the control cage.

* * * * *